US011049422B2

(12) United States Patent
Barnes

(10) Patent No.: US 11,049,422 B2
(45) Date of Patent: Jun. 29, 2021

(54) DISPLAY ASSEMBLIES FOR SURFACING MATERIALS

(71) Applicant: COLUMBIA INSURANCE COMPANY, Omaha, NE (US)

(72) Inventor: Ashley Leitner Barnes, Ringgold, GA (US)

(73) Assignee: COLUMBIA INSURANCE COMPANY, Omaha, NE (US)

( * ) Notice: Subject to any disclaimer, the term of this patent is extended or adjusted under 35 U.S.C. 154(b) by 58 days.

(21) Appl. No.: 16/665,820

(22) Filed: Oct. 28, 2019

(65) Prior Publication Data

US 2020/0135060 A1 Apr. 30, 2020

Related U.S. Application Data

(60) Provisional application No. 62/752,087, filed on Oct. 29, 2018.

(51) Int. Cl.
*G09F 5/00* (2006.01)
*A47F 7/00* (2006.01)

(52) U.S. Cl.
CPC ..... *G09F 5/00* (2013.01); *A47F 7/0042* (2013.01)

(58) Field of Classification Search
CPC ..... G09F 5/00; G09F 5/04; G09F 2005/043; A47F 7/0042
See application file for complete search history.

(56) References Cited

U.S. PATENT DOCUMENTS

| | | | | |
|---|---|---|---|---|
| 2,294,131 | A | 8/1942 | Raymond | |
| 3,590,500 | A | 7/1971 | Smith | |
| 3,694,296 | A | 9/1972 | Frontino | |
| 4,164,598 | A * | 8/1979 | Wilhelm | E04F 13/0871 428/15 |
| 4,194,307 | A | 3/1980 | Payne | |
| 5,228,857 | A * | 7/1993 | Roland | G09B 25/04 434/74 |
| 6,524,107 | B1 | 2/2003 | Brown | |
| 6,790,042 | B2 * | 9/2004 | Worth | G09B 25/00 434/75 |
| 7,448,503 | B2 | 11/2008 | Magee et al. | |
| 7,914,285 | B2 | 3/2011 | Boney | |
| D697,738 | S | 1/2014 | Bender et al. | |
| 8,961,182 | B2 | 2/2015 | Bender et al. | |

(Continued)

FOREIGN PATENT DOCUMENTS

| | | |
|---|---|---|
| AT | 503823 B1 | 7/2008 |
| DE | 4438204 A1 | 6/1995 |
| DE | 4304799 C2 | 8/1995 |

*Primary Examiner* — Gary C Hoge
(74) *Attorney, Agent, or Firm* — Ballard Spahr LLP

(57) ABSTRACT

An assembly for displaying a surfacing material can comprise a surfacing material sample defining a first pattern and a printed display having an illustration of the surfacing material. The printed display can define a second pattern. The illustration of the surfacing material can define at least a portion of the second pattern. The surfacing material sample can cover and couple to a portion of the printed display. A scale between the second pattern and the first pattern can be 1:1 so that the first pattern of the surfacing material sample cooperates with the second pattern of the printed display to provide a coordinated visualization of an installation of the surfacing material.

19 Claims, 9 Drawing Sheets

(56) References Cited

U.S. PATENT DOCUMENTS

| | | | | |
|---|---|---|---|---|
| 9,409,439 | B2 | 8/2016 | Wegrzyn | |
| 2003/0107774 | A1* | 6/2003 | Scott | G09F 5/00 358/302 |
| 2003/0157273 | A1* | 8/2003 | Kemp | B44C 5/0446 428/15 |
| 2005/0074583 | A1 | 4/2005 | Gratopp et al. | |
| 2007/0298382 | A1 | 12/2007 | Schilling | |
| 2008/0249894 | A1 | 10/2008 | Madel | |
| 2010/0055660 | A1 | 3/2010 | Hicks | |
| 2011/0042251 | A1* | 2/2011 | Bender | G09F 5/04 206/321 |

* cited by examiner

DISPLAY ASSEMBLIES FOR SURFACING MATERIALS

CROSS-REFERENCE TO RELATED APPLICATION

This application claims priority to and the benefit of the filing date of U.S. Provisional Patent Application No. 62/752,087, filed Oct. 29, 2018, which is hereby incorporated herein by reference in its entirety.

FIELD

The disclosed invention relates to displays for displaying surfacing materials, such as, for example, floor coverings or portions of floor coverings.

BACKGROUND

Surfacing materials, (e.g., tile, brick, wood, etc.) can be used for flooring, wall covering, backsplashes, and in various other applications. When presenting surfacing materials to potential buyers, it is common to provide samples (e.g., swatches). However, such samples typically cover a surface area that is smaller than that of a typical application. For example, typical samples are smaller than one square foot. Accordingly, it can be difficult to present the sample to the buyer in a manner that provides easy visualization of the surfacing material used on a larger scale. Larger samples can be too heavy, cumbersome, and, often, expensive for practical displays. For example, the production of large physical samples of a large range of flooring products can lead to significant production costs while also limiting the ability of a sales force to easily and efficiently transport a variety of flooring samples.

SUMMARY

Described herein, in various aspects, an assembly for displaying a surfacing material can comprise a surfacing material sample defining a first pattern and a printed display having an illustration of the surfacing material. The printed display can define a second pattern. The illustration of the surfacing material can define at least a portion of the second pattern. The surfacing material sample can cover and couple to a portion of the printed display. A scale between the second pattern and the first pattern can be 1:1 so that the first pattern of the surfacing material sample cooperates with the second pattern of the printed display to provide a coordinated visualization of an installation of the surfacing material.

The surfacing material sample can comprise at least one tile.

The at least one tile of the surfacing material sample can comprise a plurality of tiles.

The surfacing material can be removably coupled to the printed display.

The first pattern of the surfacing material sample can be included within the second pattern of the printed display. The surfacing material sample can be aligned with the illustration of the surfacing material of the printed display.

The printed display can comprise a printed paper material, a printed plastic material, or combinations thereof.

The printed display can illustrate grout within gaps between components of the surfacing material.

The second pattern can comprise the first pattern.

The second pattern can be the first pattern.

The display assembly can have a length of at least 18 inches and a width that is at least 18 inches.

The surfacing material can cover no more than 30% of the display assembly.

The surfacing material can comprise a plurality of separable elements.

A method can comprise attaching a surfacing material sample to a printed display so that the surfacing material sample covers a portion of the printed display. The surfacing material sample can define a first pattern. The printed display can have an illustration of the surfacing material. The printed display can define a second pattern. The illustration of the surfacing material can define at least a portion of the second pattern. A scale between the second pattern and the first pattern can be 1:1 so that the first pattern of the surfacing material sample cooperates with the second pattern of the printed display to provide a coordinated visualization of an installation of the surfacing material.

Attaching the surfacing material sample to the printed display can comprise attaching a plurality of separate elements to the printed display.

The surfacing material sample can have a texture, and the printed display can have a texture. The method can further comprise aligning the texture of the printed display with the texture of the surfacing material sample.

The texture of the surfacing material sample can comprise a grain.

A kit can comprise a surfacing material sample defining a first pattern and a printed display having an illustration of the surfacing material. The printed display can define a second pattern. The illustration of the surfacing material can define at least a portion of the second pattern. The surfacing material can be configured to couple to a portion of the printed display. A scale between the second pattern and the first pattern can be 1:1 so that the first pattern of the surfacing material sample is configured to cooperate with the second pattern of the printed display to provide a coordinated visualization of an installation of the surfacing material.

The surfacing material sample can comprise a single component.

The surfacing material sample can comprise a plurality of components.

Additional advantages of the invention will be set forth in part in the description that follows, and in part will be obvious from the description, or may be learned by practice of the invention. The advantages of the invention will be realized and attained by means of the elements and combinations particularly pointed out in the appended claims. It is to be understood that both the foregoing general description and the following detailed description are exemplary and explanatory only and are not restrictive of the invention, as claimed.

DESCRIPTION OF THE DRAWINGS

These and other features of the preferred embodiments of the invention will become more apparent in the detailed description in which reference is made to the appended drawings wherein.

DETAILED DESCRIPTION

Figure 1:
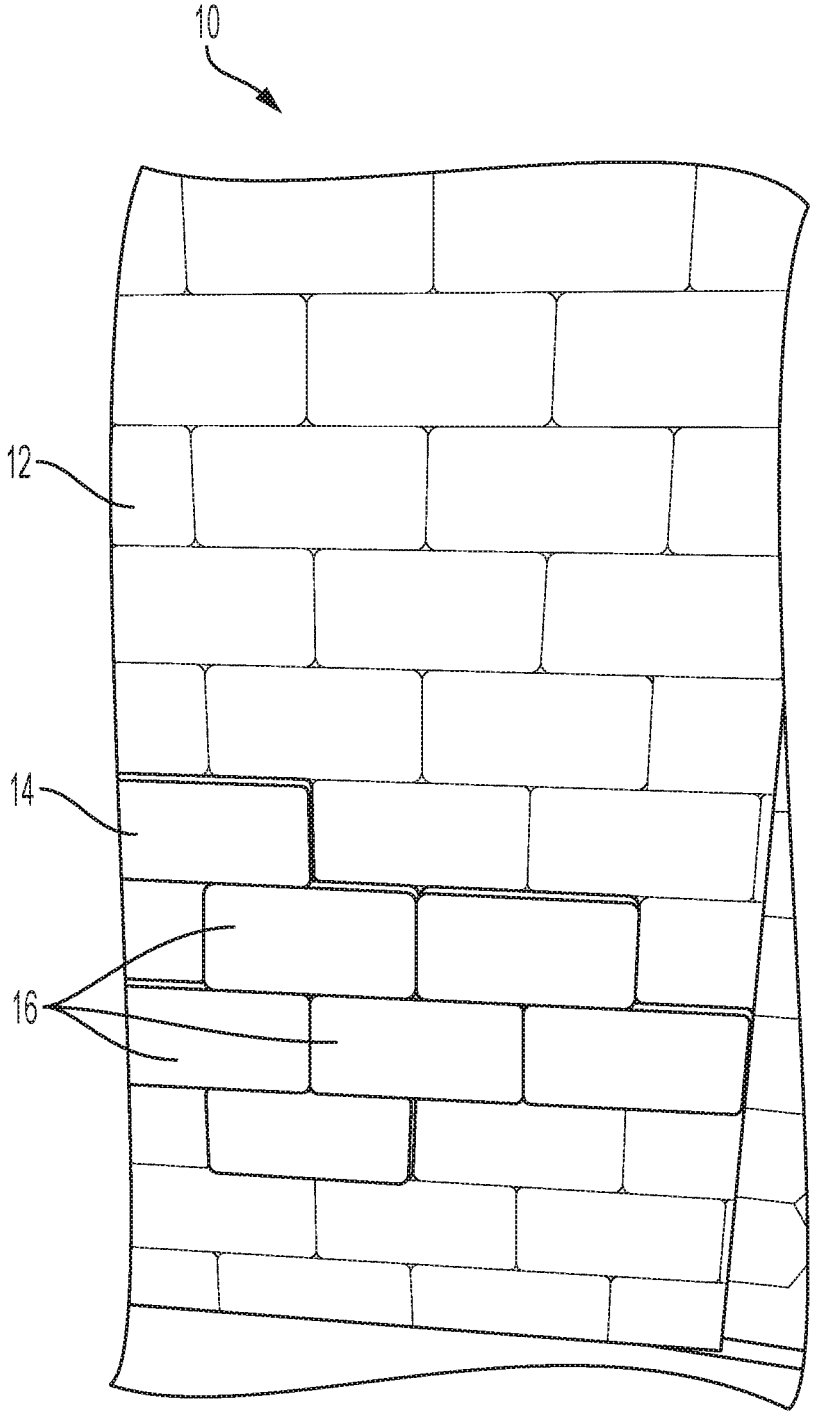
FIG. 1 is a perspective view of a first display assembly in accordance with embodiments disclosed herein.
Figure 2:
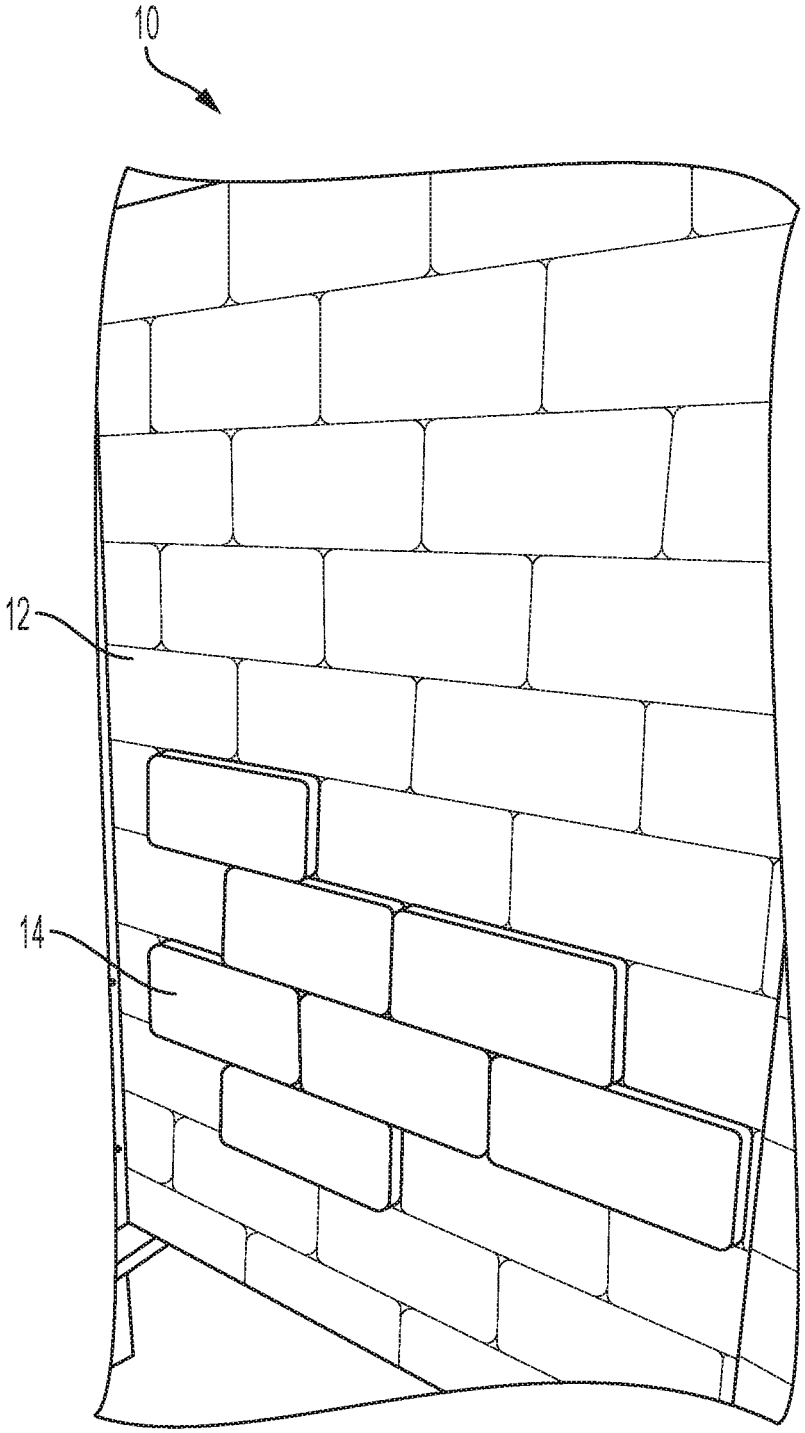
FIG. 2 is another perspective view of the first display assembly of FIG. 1.
Figure 3:
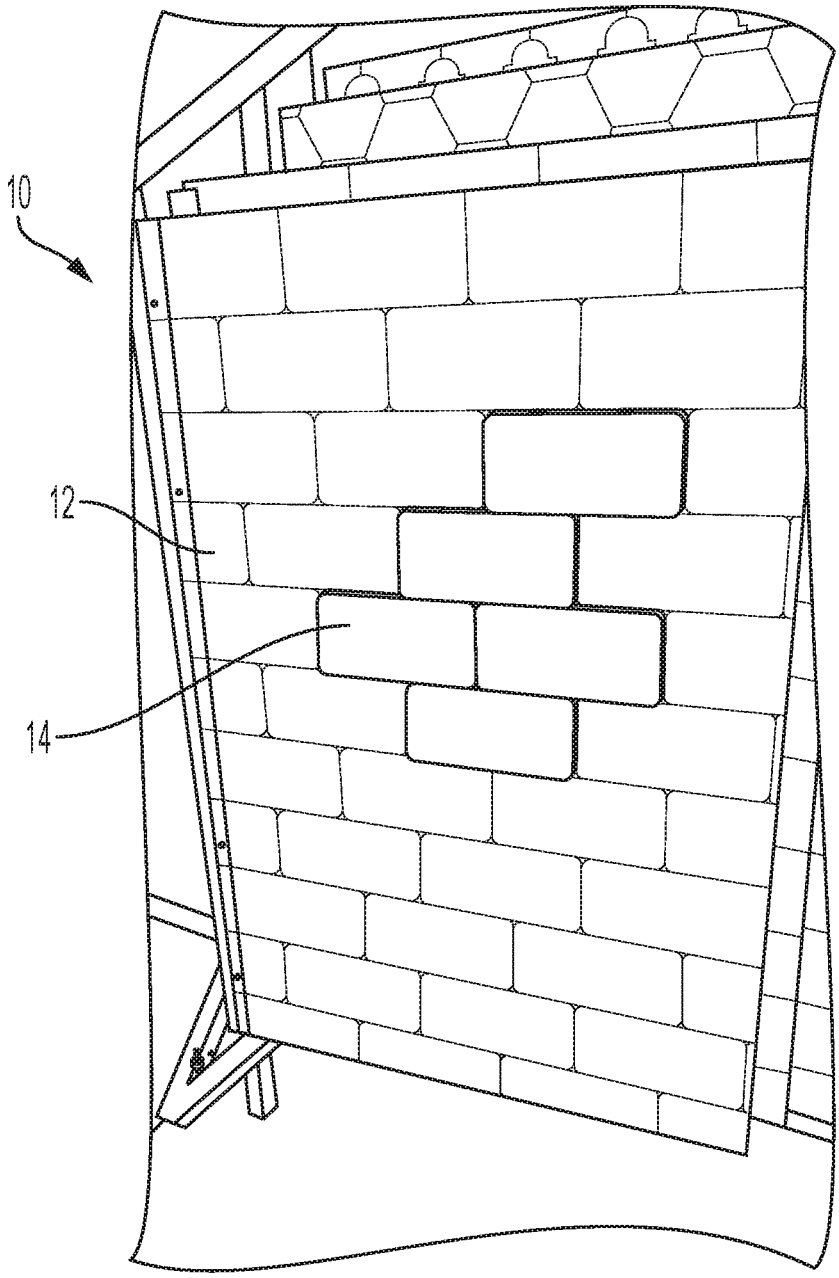
FIG. 3 is yet another perspective view of the first display assembly of FIG. 1.
Figure 4:
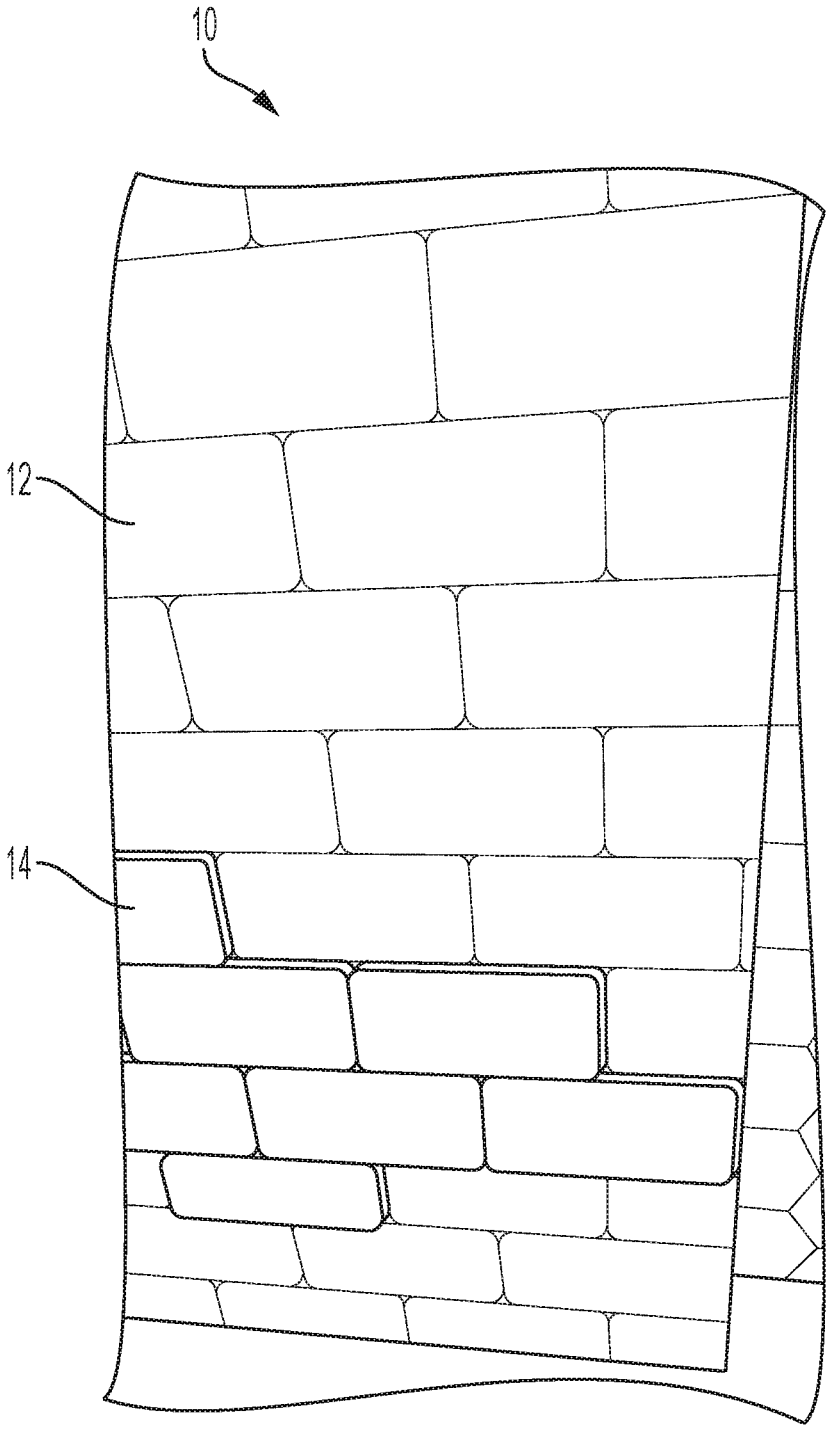
FIG. 4 is still another perspective view of the first display assembly of FIG. 1.

The present invention now will be described more fully hereinafter with reference to the accompanying drawings, in which some, but not all embodiments of the invention are shown. Indeed, this invention may be embodied in many different forms and should not be construed as limited to the embodiments set forth herein; rather, these embodiments are provided so that this disclosure will satisfy applicable legal requirements. Like numbers refer to like elements throughout. It is to be understood that this invention is not limited to the particular methodology and protocols described, as such may vary. It is also to be understood that the terminology used herein is for the purpose of describing particular embodiments only, and is not intended to limit the scope of the present invention.

Many modifications and other embodiments of the invention set forth herein will come to mind to one skilled in the art to which the invention pertains having the benefit of the teachings presented in the foregoing description and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

As used herein the singular forms "a," "an," and "the" include plural referents unless the context clearly dictates otherwise. For example, use of the term "a surfacing material sample" can refer to one or more of such samples, and so forth.

All technical and scientific terms used herein have the same meaning as commonly understood to one of ordinary skill in the art to which this invention belongs unless clearly indicated otherwise.

As used herein, the definition of the term "color" is referenced in terms of the CIELAB color scale, which was created by the International Commission on Illumination (CIE). The CIELAB color scale provides a uniform scale for measuring and comparing the color values of different samples. Three different color measurements are used to determine the CIELAB color value of a given sample: 1) a white-black color measurement; 2) a red-green color measurement; and 3) a yellow-blue color measurement. The white-black color measurement represents the amount of white present in the sample relative to the amount of black present in the sample. The red-green color measurement represents the amount of red present in the sample relative to the amount of green present in the sample. The yellow-blue color measurement represents the amount of yellow present in the sample relative to the amount of blue present in the sample. CIELAB color scale values can be obtained using color measurement instruments known in the art, including, for example, HunterLab color measurement instruments.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint. Optionally, in some aspects, when values are approximated by use of the antecedent "about," it is contemplated that values within up to 15%, up to 10%, up to 5%, or up to 1% (above or below) of the particularly stated value can be included within the scope of those aspects. Similarly, in some optional aspects, when values are approximated by use of the term "substantially," "generally," or "approximately," it is contemplated that values within up to 15%, up to 10%, up to 5%, or up to 1% (above or below) of the particular value can be included within the scope of those aspects.

As used herein, the terms "optional" or "optionally" mean that the subsequently described event or circumstance may or may not occur, and that the description includes instances where said event or circumstance occurs and instances where it does not.

The word "or" as used herein means any one member of a particular list and also includes any combination of members of that list.

The following description supplies specific details in order to provide a thorough understanding. Nevertheless, the skilled artisan would understand that the apparatus, system, and associated methods of using the apparatus can be implemented and used without employing these specific details. Indeed, the apparatus, system, and associated methods can be placed into practice by modifying the illustrated apparatus, system, and associated methods and can be used in conjunction with any other apparatus and techniques conventionally used in the industry.

Disclosed herein, in various aspects and with reference to FIGS. 1-8, are display assemblies 10 that are configured to illustrate the appearance of an installed surfacing material (i.e., an appearance of a surfacing material in its final, installed configuration). The display assembly 10 can include a printed display 12 and a surfacing material sample 14 coupled thereto. The surfacing material (and the surfacing material sample 14) may be, for example, a brick, tile (e.g., carpet, ceramic, vinyl), stone, wood, or synthetic wood material. The surfacing material sample 14 can define a first pattern, while the printed display can have or provide an illustration of the surfacing material, as it is installed, to thereby define a second pattern. The surfacing material sample 14 can cover at least a portion of the printed display. The printed display 12 can optionally comprise a substrate (e.g., a display board or other similar structure) having a surface upon which the second pattern is applied or otherwise displayed. Optionally, the second pattern can be directly printed on the surface of the substrate using conventional methods. Alternatively, the second pattern can be printed upon a sheet (or a group of sheets) that is secured (e.g., adhesively secured) to the surface of the substrate.

As shown in the Figures, a scale between the second pattern and the first pattern can be 1:1 so that the first pattern of the surfacing material sample 14 can cooperate with the second pattern of the printed display 12 to illustrate a single, overall pattern of the surfacing material. That is, the surfacing material sample 14 can attach to the printed display 12 so that the first pattern is in alignment with the second pattern to thereby provide a continuous display of the second pattern.

The printed display 12 can illustrate various aspects of the surfacing material sample 14. For example, for carpet samples, the printed display can illustrate detailed characteristics, such as warp and weft axes, tuft form (e.g., cut, loop, and the like), tuft height, carpet density, and colored and/or textured pattern of the surfacing material sample 14. When the surfacing material sample 14 illustrates carpet or carpet tiles, it is contemplated that the surfacing material sample 14 can be aligned with the printed display 12 so that the respective warp and weft axes, as well as any colored and/or textured pattern features, are aligned, thereby creating a coordinated display of the first and second patterns. For wood and/or stone, the printed display can illustrate the texture and grain, and the surfacing material sample can be attached so that the texture and grain of the material sample align with the texture and grain of the printed display, thereby creating a coordinated display of the first and second patterns. In particular, for materials like ceramic, wood, or synthetic materials, the printed display can show gloss, for example, by representing light reflection. Accordingly, it should be understood that the printed display can illustrate a pattern including more than just an outline of components of the surfacing material. Rather, the color(s), texture, and other surface characteristics (e.g., glossy or matte) illustrated on the printed display can be representative of the surfacing material sample. The surfacing material sample can attach to the printed display so that, in addition to peripheral or circumferential edges of the surfacing material sample aligning with illustrated edges on the printed display, visual features of the pattern of the surfacing material sample are aligned with corresponding visual features of the pattern of the printed display, thereby creating a coordinated display of the first and second patterns.

Optionally, in some aspects, the first pattern of the surfacing material sample 14 can be included within the second pattern of the printed display 12. In these aspects, it is contemplated that the surfacing material sample 14 can be aligned with (and, optionally, overlie) the illustration of the first pattern on the printed display 12. In still further optional aspects, it is contemplated that the second pattern can be a repeating pattern that includes repeats of the first pattern. Thus, in these aspects, it is contemplated that a plurality of the same type of surfacing material samples 14 can be assembled together to produce a single floor covering or selected portion of a floor covering. It is further contemplated that the surfacing material sample 14 can cooperate with adjacent portions of the second pattern to produce a repeating pattern.

In various aspects, it is understood that individual elements (e.g., tiles or other discrete components, which can optionally be separated by grout) of the surfacing material sample may define the first pattern. For example, it is contemplated that the first pattern can comprise two or more elements of the surfacing material. Optionally, the two or more elements of the surfacing material within the first pattern can have the same size, shape, and color characteristics. Alternatively, at least one element of the two or more elements can be different from at least one other element of the two or more elements in at least one of size, shape, or color. In further embodiments, the at least one element can comprise at least three elements, with each having differences, such as, for example, differing color, shape, size, texture, gloss, or grain orientation. According to some aspects, a surfacing material 14 can comprise a plurality of portions having different materials. For example, in some embodiments, the surfacing material can comprise a pattern of alternating stone and wood components. In further embodiments, the surfacing material can comprise a pattern of alternating carpet and tile components.

Figure 5:
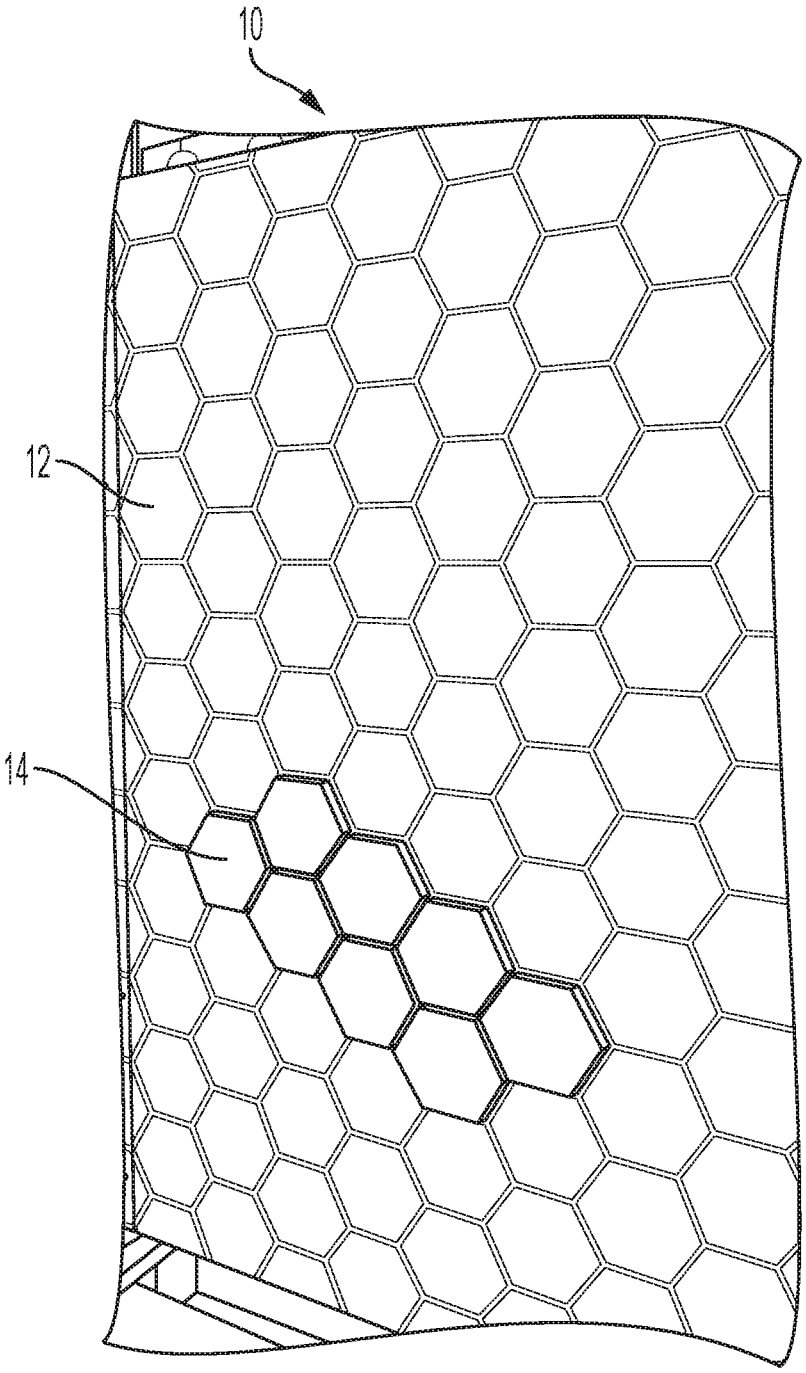
FIG. 5 is a perspective view of a second display assembly in accordance with embodiments disclosed herein.
Figure 6:
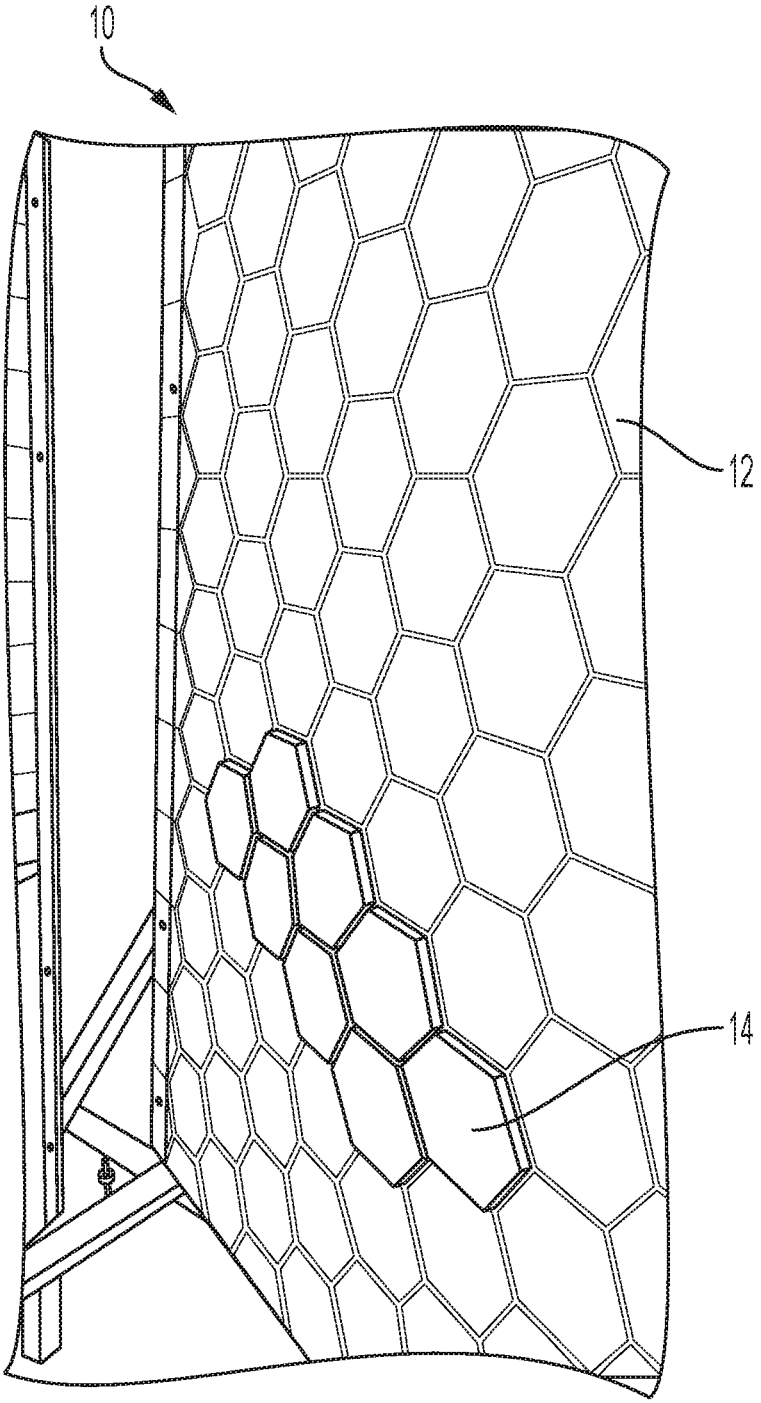
FIG. 6 is another perspective view of the second display assembly of FIG. 5.
Figure 7:
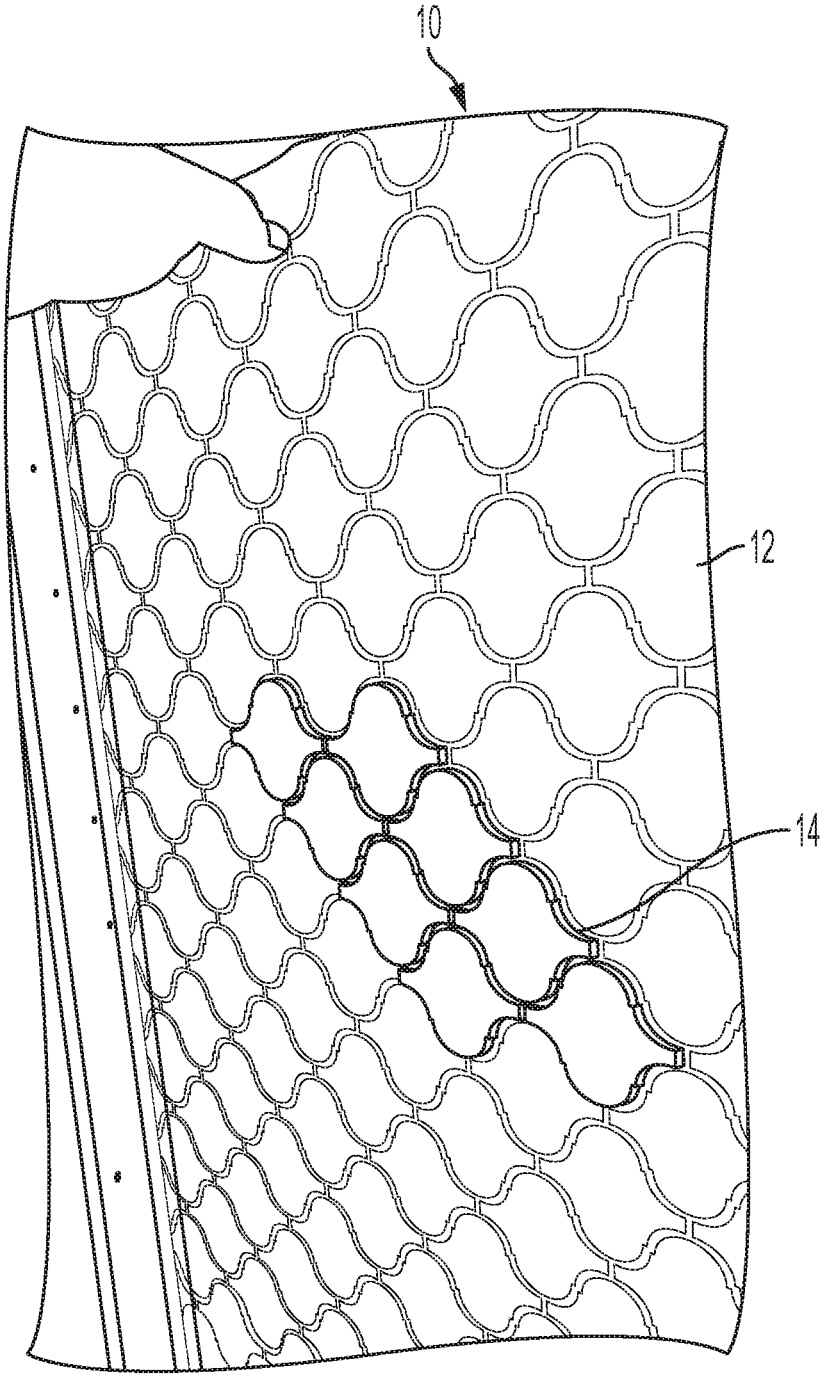
FIG. 7 is a perspective view of a third display assembly in accordance with embodiments disclosed herein.
Figure 8:
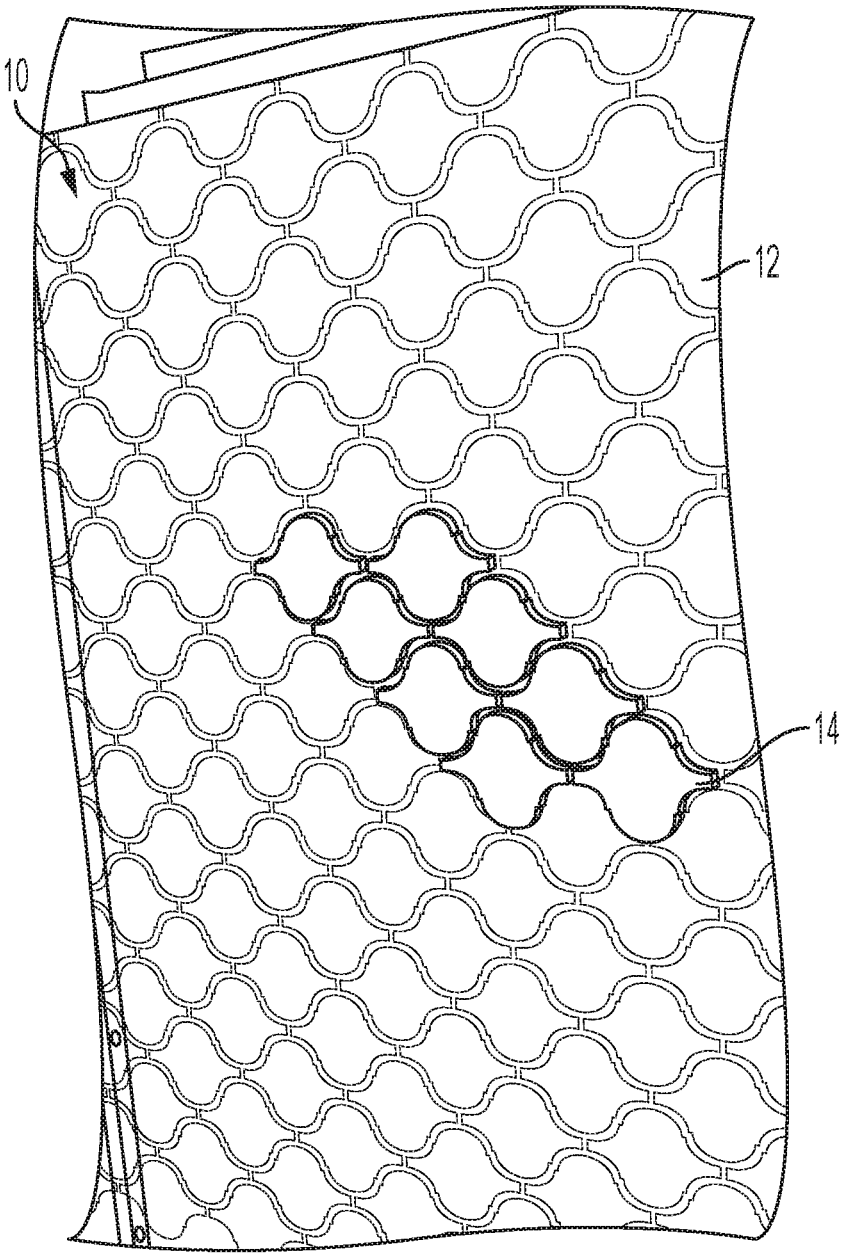
FIG. 8 is another perspective view of the third display assembly of FIG. 7.

The printed display 12 may be a printed photograph of a surface finished using the surfacing material. As one alternative, the printed display 12 may be a graphically generated representation of a finished surface comprising the surfacing material. As discussed above, the scale between the second pattern of the printed display 12 and the first pattern of the surfacing material sample can be 1:1. That is, the printed display's pattern is a 1:1 scale representation of the surfacing material's pattern. The surfacing material sample 14 may, therefore, couple to the printed display 12 in alignment with the pattern of the printed display. For example, as shown in FIGS. 5-6, the first pattern of the surfacing material sample is complementary to the portions of the second pattern of the printed display that surround the surfacing material sample. In this way, the display assembly may appear to be a continuous display of the surfacing material's pattern.

The printed display 12 may comprise a printed paper material, a printed plastic material, or combinations thereof. In some embodiments, the printed display may be a flexible material that can be rolled or folded. In further embodiments, the printed display 12 may comprise rigid material. In yet further embodiments, the printed display 12 may have hinged components, such as, for example, a tri-fold display board.

The surfacing material sample 14 may comprise a plurality of individual elements 16 (e.g., tiles). Alternatively, it is contemplated that the surfacing material sample 14 can include as few as a single such individual element. In some embodiments, the surfacing material sample may comprise a plurality of tiles that are configured to have spacing between the individual elements (tiles) 16 when applied to a surface so that said spacing can receive grout. For display assemblies 10 illustrating such tiles, the printed display 12 may include printed representations of grout between the spacing in order to show how the surfacing material may look as part of a finished surface. In some embodiments, back sides of the individual elements 16 can attach to a backing material such as a mesh (e.g., a mesh netting) so that the individual elements can be held in predetermined spacing. In these embodiments, it is contemplated that the plurality of individual elements 16 can be attached to the printed display as a unitary structure. For example, a plurality of tiles for use as a backsplash can be arranged as a mosaic and attached to a mesh. In further embodiments, the individual elements can be unattached to each other. In still further embodiments, the individual elements 16 of the surfacing material sample 14 can attach to each other via grout or other material that simulates the appearance of grout.

In some embodiments, the surfacing material sample 14 may be permanently attached to the printed display 12, for example with a permanent adhesive. In further embodiments, the surfacing material sample 14 may be removably attached to the printed display 12, for example with non-permanent fasteners, such as, for example and without limitation, hook and loop fasteners. This can be advantageous for transportation. For example, the printed display 12 can be rolled or folded and stowed without interference of the surfacing material sample 14. Moreover, according to some aspects, the printed display 12 can function, without the surfacing material sample 14 attached thereto, as a stand-alone display, illustrating how the surfacing material looks.

Accordingly, the display assembly 10 may provide a visual display of a representative appearance of a large area covered in the surfacing material 14, while also providing the texture and detail that the tangible swatch (in the form of the surfacing material sample 14) provides. The display assembly 10 may, therefore, provide a reduced weight and cost alternative to a larger swatch. The display assembly 10 may further show how the surfacing material sample 14 looks with grout, thereby providing a portrayal of a finished surface including the surfacing material.

In some embodiments, the display assembly can have a length of at least 12 inches or at least 18 inches or at least 24 inches or at least three feet. In some embodiments, the display assembly can have a width of at least 12 inches or at least 18 inches or at least 24 inches or at least three feet. In one optional embodiment, the display assembly can have a length of thirty-two inches and a width of twenty-one inches. In some embodiments, surfacing material can cover no more than 50% or 40% or 30% or 25% or 20% or 15% or 10% of the display assembly. Optionally, the individual elements of the surfacing material can correspond to actual commercial product samples. For example, when the surfacing material comprises tiles, it is contemplated that the tiles can have the same size and structure as tiles that are being sold to customers. Alternatively, it is contemplated that the surfacing material samples can be scaled (upwardly or downwardly) relative to a size of an actual commercial product.

Figure 9:
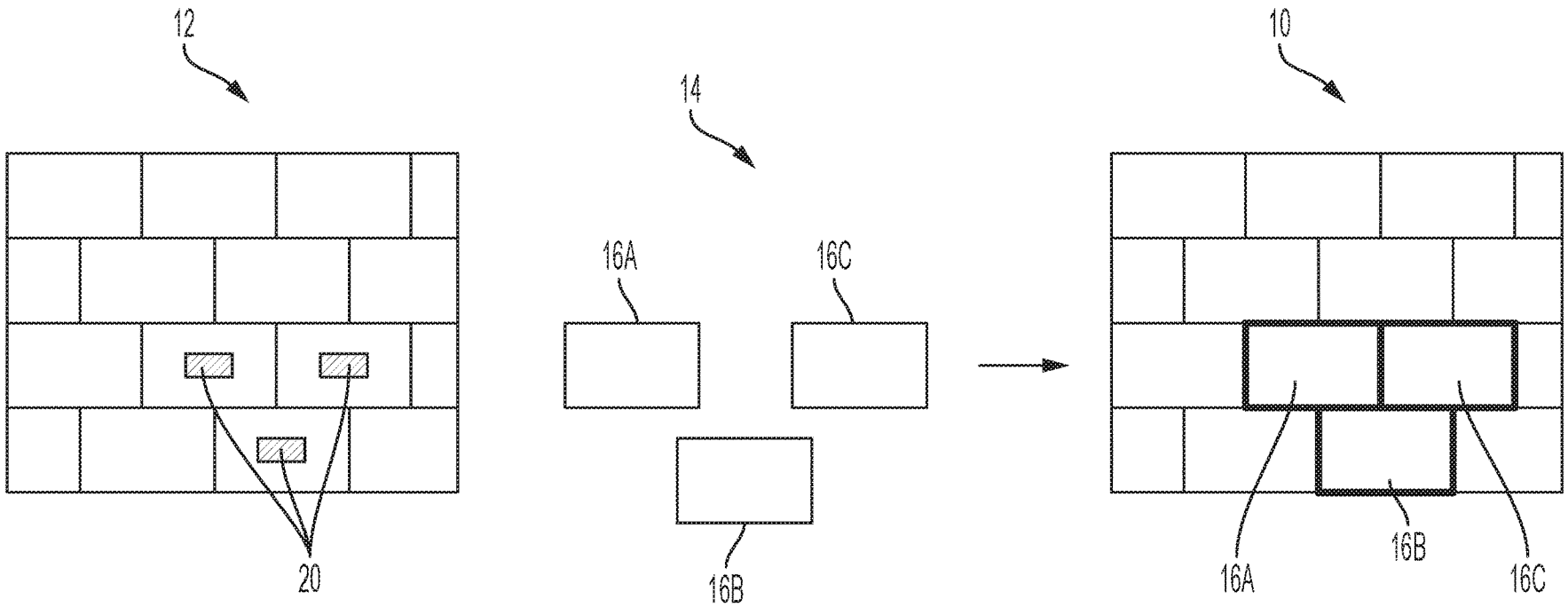
FIG. 9 is a schematic illustrating attachment of a surfacing material to a printed display.

Referring to FIG. 9, the surfacing material sample 14 can be attached to the printed display 12. In some embodiments, the surfacing material can comprise individual elements 16A, 16B, and 16C. As stated herein, the individual elements 16A, 16B, and 16C can be separate components or connected via a backing material prior to attachment to the printed display 12. In some embodiments, the printed display can have an attachment material (e.g., one of a hook and loop material 20 for attachment to the other of the hook and loop material, a pressure sensitive adhesive, etc.). The surfacing material samples 14 can be positioned in alignment with the printed display 12 so that the first pattern of the surfacing material sample 14 aligns with the second pattern of the printed display 12, thereby integrating into a cohesive display showing a single overall pattern.

A kit can comprise a printed display 12 and at least one surfacing material sample 14. The surfacing material sample 14 can comprise one or more independent elements 16. Optionally, the surfacing material sample 14 can comprise a plurality of independent elements 16 that are separately attachable to the printed display 12. Alternatively, the surfacing material sample 14 can comprise a single element 16, which can optionally depict a plurality of individual flooring elements (e.g., a plurality of individual tiles).

EXEMPLARY ASPECTS

In view of the described devices, systems, and methods and variations thereof, herein below are described certain more particularly described aspects of the invention. These particularly recited aspects should not however be interpreted to have any limiting effect on any different claims containing different or more general teachings described herein, or that the "particular" aspects are somehow limited in some way other than the inherent meanings of the language literally used therein.

Aspect 1: An assembly for displaying a surfacing material, the assembly comprising: a surfacing material sample defining a first pattern; and a printed display having an illustration of the surfacing material, wherein the printed display defines a second pattern, wherein the illustration of the surfacing material defines at least a portion of the second pattern, wherein the surfacing material sample covers and is coupled to a portion of the printed display, wherein a scale between the second pattern and the first pattern is 1:1 so that the first pattern of the surfacing material sample cooperates with the second pattern of the printed display to provide a coordinated visualization of an installation of the surfacing material.

Aspect 2: The display assembly according to aspect 1, wherein the surfacing material sample comprises at least one tile.

Aspect 3: The display assembly according to aspect 1 or aspect 2, wherein the at least one tile of the surfacing material sample comprises a plurality of tiles.

Aspect 4: The display assembly according to any one of the preceding aspects, wherein the surfacing material is removably coupled to the printed display.

Aspect 5: The display assembly according to any one of the preceding aspects, wherein the first pattern of the surfacing material sample is included within the second pattern of the printed display, and wherein the surfacing material sample is aligned with the illustration of the surfacing material of the printed display.

Aspect 6: The display assembly according to any one of the preceding aspects, wherein the printed display comprises a printed paper material, a printed plastic material, or combinations thereof.

Aspect 7: The display assembly according to any one of the preceding aspects, wherein the printed display illustrates grout within gaps between components of the surfacing material.

Aspect 8: The display assembly according to any one of the preceding aspects, wherein the second pattern comprises the first pattern.

Aspect 9: The display assembly according to any one of the preceding aspects, wherein the second pattern is the first pattern.

Aspect 10: The display assembly according to any one of the preceding aspects, wherein the display assembly has a length of at least 18 inches and a width that is at least 18 inches.

Aspect 11: The display assembly according to any one of the preceding aspects, wherein the surfacing material covers no more than 30% of the display assembly.

Aspect 12: The display assembly according to any one of the preceding aspects, wherein the surfacing material comprises a plurality of separable elements.

Aspect 13: A method comprising: attaching a surfacing material sample to a printed display so that the surfacing material sample covers a portion of the printed display, wherein the surfacing material sample defines a first pattern, wherein the printed display has an illustration of the surfacing material, wherein the printed display defines a second pattern, wherein the illustration of the surfacing material defines at least a portion of the second pattern, wherein a scale between the second pattern and the first pattern is 1:1 so that the first pattern of the surfacing material sample cooperates with the second pattern of the printed display to provide a coordinated visualization of an installation of the surfacing material.

Aspect 14: The method according to aspect 13, wherein attaching the surfacing material sample to the printed display comprises attaching a plurality of separate elements to the printed display.

Aspect 15: The method according to aspect 13 or aspect 14, wherein the surfacing material sample has a texture and the printed display has a texture, the method further comprising aligning the texture of the printed display with the texture of the surfacing material sample.

Aspect 16: The method according to aspect 15, wherein the texture of the surfacing material sample comprises a grain.

Aspect 17: A kit comprising: a surfacing material sample defining a first pattern; and a printed display having an illustration of the surfacing material, wherein the printed display defines a second pattern, wherein the illustration of the surfacing material defines at least a portion of the second pattern, wherein the surfacing material is configured to couple to a portion of the printed display, wherein a scale between the second pattern and the first pattern is 1:1 so that the first pattern of the surfacing material sample is configured to cooperate with the second pattern of the printed display to provide a coordinated visualization of an installation of the surfacing material.

Aspect 18: The kit according to aspect 17, wherein the surfacing material sample comprises a single component.

Aspect 19: The kit according to aspect 17, wherein the surfacing material sample comprises a plurality of components.

Although several embodiments of the invention have been disclosed in the foregoing specification, it is understood by those skilled in the art that many modifications and other embodiments of the invention will come to mind to which the invention pertains, having the benefit of the teaching presented in the foregoing description and associated drawings. It is thus understood that the invention is not limited to the specific embodiments disclosed hereinabove, and that many modifications and other embodiments are intended to be included within the scope of the appended claims. Moreover, although specific terms are employed herein, as well as in the claims which follow, they are used only in a generic and descriptive sense, and not for the purposes of limiting the described invention, nor the claims which follow.

What is claimed is:

1. An assembly for displaying a surfacing material, the assembly comprising:

a surfacing material sample defining a first pattern; and a printed display having an illustration of the surfacing material, wherein the printed display defines a second pattern, wherein the illustration of the surfacing material defines at least a portion of the second pattern, wherein the surfacing material sample covers and is coupled to a portion of the printed display, wherein a scale between the second pattern and the first pattern is 1:1 so that the first pattern of the surfacing material sample cooperates with the second pattern of the printed display to provide a coordinated visualization of an installation of the surfacing material.

2. The display assembly according to claim 1, wherein the surfacing material sample comprises at least one tile.

3. The display assembly according to claim 2, wherein the at least one tile of the surfacing material sample comprises a plurality of tiles.

4. The display assembly according to claim 1, wherein the surfacing material is removably coupled to the printed display.

5. The display assembly according to claim 4, wherein the first pattern of the surfacing material sample is included within the second pattern of the printed display, and wherein the surfacing material sample is aligned with the illustration of the surfacing material of the printed display.

6. The display assembly according to claim 1, wherein the printed display comprises a printed paper material, a printed plastic material, or combinations thereof.

7. The display assembly according to claim 1, wherein the printed display illustrates grout within gaps between components of the surfacing material.

8. The display assembly according to claim 1, wherein the second pattern comprises the first pattern.

9. The display assembly according to claim 8, wherein the second pattern is the first pattern.

10. The display assembly according to claim 1, wherein the display assembly has a length of at least 18 inches and a width that is at least 18 inches.

11. The display assembly according to claim 1, wherein the surfacing material covers no more than 50% of the display assembly.

12. The display assembly according to claim 1, wherein the surfacing material comprises a plurality of separable elements.

13. A method comprising:

attaching a surfacing material sample to a printed display so that the surfacing material sample covers a portion of the printed display, wherein the surfacing material sample defines a first pattern, wherein the printed display has an illustration of the surfacing material, wherein the printed display defines a second pattern, wherein the illustration of the surfacing material defines at least a portion of the second pattern, wherein a scale between the second pattern and the first pattern is 1:1 so that the first pattern of the surfacing material sample cooperates with the second pattern of the printed display to provide a coordinated visualization of an installation of the surfacing material.

14. The method according to claim 13, wherein attaching the surfacing material sample to the printed display comprises attaching a plurality of separate elements to the printed display.

15. The method according to claim 13, wherein the surfacing material sample has a texture and the printed display has a texture, the method further comprising aligning the texture of the printed display with the texture of the surfacing material sample.

16. The method according to claim 15, wherein the texture of the surfacing material sample comprises a grain.

17. A kit comprising:

a surfacing material sample defining a first pattern; and a printed display having an illustration of the surfacing material, wherein the printed display defines a second pattern, wherein the illustration of the surfacing material sample defines at least a portion of the second pattern, wherein the surfacing material sample is configured to couple to a portion of the printed display, wherein a scale between the second pattern and the first pattern is 1:1 so that, when the surfacing material sample is coupled to the printed display, the first pattern of the surfacing material sample is configured to cooperate with the second pattern of the printed display to provide a coordinated visualization of an installation of the surfacing material.

18. The kit according to claim 17, wherein the surfacing material sample comprises a single component.

19. The kit according to claim 17, wherein the surfacing material sample comprises a plurality of components.

* * * * *